US008093162B2

(12) United States Patent
Hartl et al.

(10) Patent No.: US 8,093,162 B2
(45) Date of Patent: Jan. 10, 2012

(54) NON-WOVEN MATERIAL COMPRISING POLYMER FIBERS USING MIXTURES WITH AMPHIPHILIC BLOCK COPOLYMERS AS WELL AS THEIR PRODUCTION AND USE

(75) Inventors: Helmut Hartl, Braunschweig (DE); Markus Haberer, Osnabrück (DE)

(73) Assignee: Fiberweb Corovin GmbH, Peine (DE)

( * ) Notice: Subject to any disclaimer, the term of this patent is extended or adjusted under 35 U.S.C. 154(b) by 795 days.

(21) Appl. No.: 11/914,857

(22) PCT Filed: Mar. 15, 2006

(86) PCT No.: PCT/EP2006/002346

§ 371 (c)(1), (2), (4) Date: Jun. 27, 2008

(87) PCT Pub. No.: WO2006/128507

PCT Pub. Date: Dec. 7, 2006

(65) Prior Publication Data

US 2008/0268737 A1 Oct. 30, 2008

(30) Foreign Application Priority Data

May 30, 2005 (DE) ..... 10 2005 025 055

(51) Int. Cl.
*D04H 13/00* (2006.01)
*D02G 3/04* (2006.01)

(52) U.S. Cl. ..... 442/361; 428/364; 428/365; 428/394

(58) Field of Classification Search ..... 442/327, 442/334–339, 360, 361; 428/364, 365, 394
See application file for complete search history.

(56) References Cited

U.S. PATENT DOCUMENTS

| | | | | | |
|---|---|---|---|---|---|
| 4,839,228 | A * | 6/1989 | Jezic et al. | ..... | 428/401 |
| 5,266,392 | A * | 11/1993 | Land et al. | ..... | 442/400 |
| 5,460,884 | A * | 10/1995 | Kobylivker et al. | ..... | 428/373 |
| 2003/0055179 | A1 * | 3/2003 | Ota et al. | ..... | 525/242 |
| 2008/0242790 | A1 * | 10/2008 | Leyrer et al. | ..... | 524/459 |

FOREIGN PATENT DOCUMENTS

| | | | |
|---|---|---|---|
| WO | WO 00/28122 | | 5/2000 |
| WO | WO 2004/035635 | | 4/2004 |
| WO | WO 2005/077991 | * | 8/2005 |

OTHER PUBLICATIONS

Office Action for Chinese Application No. 200680019406.8 dated Jun. 24, 2010.
International Search Report and Written Opinion for PCT/EP2006/002346 filed Mar. 15, 2006.

* cited by examiner

*Primary Examiner* — Angela Ortiz
*Assistant Examiner* — Jennifer Steele
(74) *Attorney, Agent, or Firm* — Alston & Bird LLP

(57) ABSTRACT

The present invention relates to the production of a non-woven material having high extensibility and comprising polymer fibers using mixtures with amphiphilic block copolymers as compatibilizers for preparing blends, as well as their production and use.

19 Claims, No Drawings

NON-WOVEN MATERIAL COMPRISING POLYMER FIBERS USING MIXTURES WITH AMPHIPHILIC BLOCK COPOLYMERS AS WELL AS THEIR PRODUCTION AND USE

CROSS REFERENCE TO RELATED APPLICATIONS

This application is a national stage application filed under 35 USC 371 of International Application No. PCT/EP2006/002346, filed Mar. 15, 2006, which claims priority from German patent application 10 2005 025 055.6 filed May 30, 2005.

FIELD AND BACKGROUND OF THE INVENTION

The present invention relates to the production of a non-woven material having high extensibility and comprising polymer fibers using mixtures of amphiphilic block copolymers as compatibilizers for preparing blends as well as their production and use.

Non-woven materials are a class of product which has been known on the hygiene market for many years. Although non-woven materials can basically be produced from all the known types of fibers, only a few polymers have gained acceptance in this market, be it for reasons of technology or price.

The most common material is polypropylene.

There are several reasons for this:

Polypropylene is available in large quantities and different qualities at a favorable price.

Polypropylene is easy to handle in melt-spinning processes.

The non-woven materials which can be produced from polypropylene are satisfactory, on the basis of their properties with regard to application technology, for a number of areas of application in the hygiene market.

However, non-woven materials of pure polypropylene often do not have the extensibility which is required for non-woven materials in the field of hygiene products. In order to provide a remedy here, for example, elastic polymers are mixed with the polypropylene. Thereby the extensibility of the resulting non-woven materials is in fact improved but the production process is clearly more complicated since the spinning of threads from mixtures of this type is far more difficult than from polypropylene.

An additional polymer used in the field of hygiene is polyethylene. Non-woven materials of this material distinguish themselves by their softness. Non-woven materials of linear polyethylene with low density have high extension properties and outstanding properties with respect to handle, softness, and drape as, for example, is known from U.S. Pat. No. 4,644,045 by Fowells. However, materials of this type have not found commercial acceptance because they do not provide acceptable resistance to abrasion. The bonding of the LLDPE filaments in a spunbonded web with acceptable resistance to abrasion has proven itself very difficult because an acceptable bonding is observed at a temperature just under the point at which the filaments begin to melt and adhere to the calender. Due to this very narrow bonding range and the resulting resistance to abrasion and fuzzing properties, spunbonded LLDPE non-woven materials have not found wide commercial acceptance for the above-mentioned applications.

For reasons of price as well as technology the amount of polyethylene used in the field of hygiene is clearly less than that of polypropylene. In comparison to that, other polymers, such as, for example, polyester, are used even more rarely in the field of hygiene.

The production of non-woven materials using fibers of a blend of polypropylene and polyethylene, especially of HDPE, is known. Due to the incompatibility of the two polymers the presence of a compatibilizer for preparing blends during the preparation process is absolutely necessary to obtain a miscible and spinnable system.

As compatibilizers for preparing blends, copolymers in which polypropylene and polyethylene units are joined to one another in different proportions are used as a matter of priority. In order to ensure sufficient compatibilizing for preparing blends of the non-miscible polymers, additives of these copolymers are required on the orders of magnitude of 10% by weight to 20% by weight relative to the total mixture. However, additives of copolymers on this order of magnitude often lead to undesirable changes in properties which are characterized by the fact that individual properties of the resulting mixture are worse than those properties of pure polypropylene or polyethylene respectively.

For several years, elastic non-woven materials have also found application in the hygiene sector. These non-woven materials distinguish themselves by a clearly higher extensibility vis-à-vis the traditional hygienic non-woven materials of polypropylene or polyethylene. Base materials for the production of these elastic non-woven materials are in most cases elastic block copolymers, for example, on the basis of polyurethane.

Similar tendencies are to be observed with the use of polyolefin elastomers, which are essentially also block copolymers, and most often comprise polypropylene and polyethylene.

Non-woven materials using elastic polyurethanes as well as non-woven materials using polyolefin elastomers are, due to their composition and the complexity of production associated therewith, very costly. From the financial point of view, this is an enormous disadvantage for their use in hygiene products.

There are different approaches to producing non-woven materials with high extensibility which comprise polyethylene.

From WO0034385 a mixture for the production of fibers consisting of polypropylene and a polypropylene/polyethylene copolymer with an improved spinnability and extensibility is known, where the fibers are spun with a fineness between 1 and 50 denier (den). In the mixture 0.1% by weight to 30% by weight of polyethylene with an MFI $\leqq$10 g/10 min (190° C., 2.16 kg), preferably $\leqq$5 g/10 min (190° C., 2.16 kg), and a density between 0.85 g/cm$^3$ and 0.97 g/cm$^3$ are used, where the rest of the mixture consists of polypropylene with an MFI $\geqq$12 g/10 min (230° C., 2.16 kg). The fibers are thermobonded in the temperature range between 127° C. and 137° C. In this case either a polyethylene is used as a copolymer of a polyethylene and an $\alpha$-olefin with an MFI between 5-10 g/10 min (190° C., 2.16 kg) and a density=0.87 g/cm$^3$ or a homopolymer or copolymer of a polyethylene and an $\alpha$-olefin with an MFI <5 g/10 min (190° C., 2.16 kg) and a density $\geqq$0.87 g/cm$^3$. The production of the mixtures is done on a co-rotating double-screw extruder. In a subsequent spinning process the threads are stretched via a take-off roller.

In the publication US2004038022 the production of an extensible non-woven material of fibers is disclosed where the fibers were produced from a polypropylene/polyethylene mixture with a polyethylene portion of 0.5-22% by weight and the fibers were consolidated at a bonding temperature which is 15-20° F. under the temperatures at which the reference non-woven materials of pure polypropylene are customarily consolidated. The optimal bonding temperature was determined at a stretching rate of 6% per minute. The extensibility of the claimed non-woven material is at least 20% higher than that of a comparable non-woven material of polypropylene at stretching rates of 10,000 to 11,000% per second.

In this case the following were used:

Polypropylene with an MFI ≧25 g/10 min (230° C., 2.16 kg) as a homopolymer or copolymer with polyethylene and a polyethylene with a short chain branching distribution index, SCBDI) ≧50% in the form of a copolymer of a ethylene and α-olefin whose MFI ratio $MFI_{10}/MFI_2 \geqq 5.63$, where the polyethylene has a density between 0.855 g/cm$^3$ and 0.88 g/cm$^3$ and an MFI between 0.01-10 g/10 min (190° C., 2.16 kg), preferably <5 g/10 min (190° C., 2.16 kg).

For example, with a non-woven material which has a base weight of 20 g/m$^2$ and fibers with ca. 2 den, 100% extension in the CD direction and 93% extension in the MD direction are achieved with a mixing ratio of polypropylene/polyethylene of 90/10. In this case the mixture was produced on a double-screw extruder without the addition of additives.

The consolidation of the fibers to form a non-woven material was done in this case at temperatures between 132° C. and 154° C.

From WO00/04215 a method for the production of a thermally bonded, highly extensible non-woven material, in particular using core-sheath polypropylene staple fibers is known. The extensibility of the non-woven material is in this case achieved by a special bonding pattern which has been produced by means of a calender.

In U.S. Pat. No. 5,804,286 an extensible textile composite material using a polypropylene/polyethylene blend and a block or graft polyolefin copolymer or terpolymer is claimed, said blend being at least partially miscible with polyethylene and PE.

In U.S. Pat. No. 5,921,973 possibilities for use of extensible, non-elastic non-woven materials are claimed which are contained as components in an elastic composite material. The composite material consists of a layer of non-elastic, extensible staple fibers which were produced from a blend of polyethylene and polypropylene and of an elastic layer in the form of an elastic film. Possibilities for use for the composite material are seen in the area of throw-away products, such as, for example, diapers, incontinence products, and feminine hygiene.

From U.S. Pat. No. 5,616,412 fibers of a mixture of polypropylene and polystyrene are known which have extensions of more than 700% for fiber diameters between 2 and 4 den. The mixture was produced via a double-screw extruder, where the following mixture composition has been chosen:

polypropylene: 90-98% by weight with an MFI of 20 g/10 min and polystyrene: 2-10% by weight with an MFI of 1.5 g/10 min.

In U.S. Pat. No. 5,322,728 fibers are described from which textile articles with extensibilities up to ca. 100% in the MD direction can be produced which have been spun in the melt-blown as well as in the melt-spinning processes. Clear advantages with regard to the softness and the elastic recoverability were already observed at 50% extension of the textile articles. The textile articles are produced from a copolymer of ethylene and at least one comonomer, where styrene is preferably used as the copolymer, but also propylene. The textile articles thus obtained find application in drapes and articles of clothing.

U.S. Pat. No. 5,494,736 discloses a highly extensible non-woven material which is produced by the fibers laid down preferably being oriented in the CD direction. The bonding surface of the consolidated non-woven material is specified as 8-25% relative to the total surface of the non-woven material. Staple fibers are used which are put in a preferred direction by carding.

From EP1461479/WO03052179 the production of extensible fibers of polymer compositions, preferably containing polyethylene, polypropylene, polyethylene-polypropylene copolymers, are known where the fibers are only stretched to a slight extent. The stretching ratio is <400, preferably <150, and particularly preferably <50. In order to achieve the fiber strengths between 1.5 and 4 dtex customary in spinning fibers, the melt must be pressed through particularly small spinnerets. Diameters of <200 μm, quite particularly preferably <100 μm are specified. In order to be able to produce these fibers, polymers with an MFI, e.g. for polypropylene compositions, of at least 400 g/10 min (230° C., 2.16 kg) are required.

Splittable multi-component fibers for extensible non-woven materials, e.g. of polyolefins, which have an extensibility of over 800%, are disclosed in US20040161994. Their production is done in a melt-spinning process where the resulting fibers are essentially unstretched and thus extensible and splittable. Instead of spinnerets with very small bore diameters, such as, for example, are known from EP1461479, spinnerets with bore diameters are used in US20040161994 which permit the spinning of fibers whose diameter is =40 μm.

Subsequently, the fibers are split in order to obtain those fiber finenesses which are required for non-woven materials in the fields of application such as, for example, throw-away articles in the form of diapers, incontinence products, feminine hygiene articles, or wipes.

An area-measured material in the form of a composite material consisting of a rubber-elastic material of thermoplastic elastomers and a non-woven material is disclosed in US020040166756 and is, for example, suitable for use in throw-away articles. The non-woven material contains non-elastic filaments, e.g. consisting of polypropylene, which are preferably laid out in the MD direction. Perpendicular to this preferred direction the area-measured material has an extensibility of more than 100%.

From US2002039637 non-woven materials were produced from a mixture of polypropylene, polyethylene, and a commercially obtainable compatibilizer for preparing blends in the form of a block or graft copolymer, e.g. of the Catalloy™ copolymer from the Montell company. In this case the compatibilizer for preparing blends is added to between 15% by weight and 30% by weight relative to the total mixture. At peak load, extensions of over 500% were observed in the case of these non-woven materials.

In WO0149908 multi-component fibers are described for the production of non-woven materials with high extensibility. In one embodiment polyolefin mixtures are used where the lower melting polymer forms the dominant continuous phase of the multi-component fiber and the higher melting polymer forms the disperse phase included in the continuous phase. The lower melting polymer is added to the mixture on an order of magnitude of at least 50% by weight relative to the total mixture. For the production of the polymer mixture, for example, a polyethylene with a density of at least 0.945 g/cm$^3$, an MFI >10 g/10 min, and a polypropylene with an MFI of at least 20 g/10 min is used. At peak load, extensions of at least 100% were observed in the case of these non-woven materials.

Also known are extensible non-woven materials from U.S. Pat. No. 5,593,768. The multi-component fibers used in this case comprise a dominant continuous phase and a discontinuous highly disperse phase of at least two different thermoplastic polymers where the highly disperse phase forms elongated fibrillar domains which are oriented in the direction of the fiber axis within the continuous phase of the fiber. In one embodiment the dominant continuous phase is formed by isotactic polypropylene and the discontinuous phase is formed by polyethylene on orders of magnitude between 2.5% by weight to 20% by weight relative to the total mixture. In this case extensions of up to 128% were observed in the non-woven material.

The known approaches to the production of non-woven materials having high extensibility, which comprise polyethylene as a primary constituent of the mixture and polypropylene type [sic] as a secondary constituent, are often very costly and time-consuming. For the preparation of this mixture an intensive energy input is required during the homogenization so that in many cases double-screw extruders must be used.

In order to ensure the processability and, in particular, the spinnability of these incompatible polymers at all, and to impart a sufficient level of properties to the end product in the form of fibers or non-woven materials, compatibilizers for preparing blends in the form of block and/or graft copolymers are necessary in addition, where said block and/or graft copolymers can assume in the case of the previously known compatibilizers for preparing blends, an order of magnitude of approximately 10% by weight to 20% by weight relative to the total mixture, and formulate the end product in a more costly manner.

Time-consuming and thus also more costly are technologies for the production of extensible non-woven materials on the basis of polypropylene, which are based on the use of calendars with special bonding patterns in order to establish definite extension properties in the consolidated non-woven material. The mounting and dismounting of calender rollers as well as the checking and optimization of bonding patterns, which usually has as a consequence the re-embossing of calender rollers, are time-consuming and thus expensive.

Thus, it would be advantageous to have additives for processing mixtures of non-miscible polymers for the production of extensible polymer-fiber non-woven materials which, with regard to their compatibilizing for preparing blends, show a significantly improved effect, and due to this can be dosed at a lower rate and require less effort in preparation.

SUMMARY OF THE INVENTION

It is the objective of the present invention to provide an extensible non-woven material using a mixture of at least one polypropylene and one polymer not miscible with polypropylene as well as a compatibilizer for preparing blends where small amounts of the compatibilizer for preparing blends are intended to lead to a sufficient mixing of the polymers used with a justifiable complexity of machine technology.

This objective is realized with a non-woven material having high extensibility and comprising polymer fibers with the features of claim 1. Additional advantageous developments, processes, and applications are given in the following claims.

Surprisingly, it was found that this objective can be achieved using compatibilizers for preparing blends containing amphiphilic block copolymers without introducing costly elastomers.

The present invention provides for a non-woven material having high extensibility and comprising polymer fibers of a mixture of at least one polypropylene and one additional polymer not miscible with polypropylene as well as at least one block copolymer as a compatibilizer for preparing blends where the block copolymer comprises at least one hydrophobic block (A) essentially consisting of isobutene units and at least one hydrophilic block (B) essentially consisting of oxalkylene units.

The term "non-woven materials having high extensibility" denotes non-woven materials which can be extended in the MD direction and CD direction without necessarily showing a complete or even only partial recovery of the original form on discontinuation of the tensile force.

The term "fibers" is used to include staple fibers with a discrete length as well as filaments.

The term "polymer" is used in the general sense and is intended to include homopolymers and arbitrary copolymers such as, for example, graft copolymers and terpolymers.

The term "mixture" is used here, also generally, and is intended to include "non-miscible" and "miscible" polymer mixtures.

Polymers are considered as "non-miscible" if they are present in the melted state in separate, distinct phases.

The term "compatibilizer for preparing blends" is used for copolymers, graft copolymers, and terpolymers which serve for compatibilizing for preparing blends of non-miscible polymer mixtures in order, for example, to ensure their common processing and spinnability.

An extension of the invention provides that the non-woven material having high extensibility and comprising polymer fibers is prepared from at least one polypropylene and one additional polymer not miscible with polypropylene and of an additional mixture constituent of at least one non-miscible polymer and one block copolymer as a compatibilizer for preparing blends where the block copolymer comprises at least one hydrophobic block (A) essentially consisting of isobutene units and at least one hydrophilic block (B) essentially consisting of oxalkylene units.

A non-woven material having high extensibility and comprising polymer fibers is obtained in one embodiment of the invention by the fact that the polymer not miscible with polypropylene is essentially present as a discontinuous and finely dispersed phase within the polypropylene, which forms the dominant continuous phase of the polymer fiber.

In the case in which the mixture is present as a dominant continuous phase and there is at least one discontinuous phase, other polymers can also be present, which are miscible either with one, or the other, or both polymer phases.

Advantageously, the inventive non-woven material of polymer fibers has, through the use of the additional polymer incompatible with polypropylene, preferably HDPE, and at least one compatibilizer for preparing blends, properties which are distinguished only insignificantly from the mechanical properties of the non-woven materials of pure polypropylene, where in addition an improved extension behavior has been observed.

According to the invention, the extensible non-woven material comprises an addition of a compatibilizer for preparing blends.

The amphiphilic block copolymers used inventively as compatibilizers for preparing blends have at least one hydrophobic block (A) and also at least one hydrophilic block (B). The blocks (A) and (B) are joined to one another by means of suitable linking groups. The blocks (A) and (B) respectively can each be linear or else can each have branches.

Block copolymers of this kind are known and can be prepared on the basis of methods and starting compounds known in principle to the skilled worker.

The hydrophobic blocks (A) are composed substantially of isobutene units. They are obtainable by polymerizing isobutene. The blocks may also, however, include other comonomers as constituent units, to a minor extent. Constituent units of this kind may be used to fine-tune the properties of the block. Comonomers for mention, besides 1-butene and cis- or trans-2-butene, include, in particular, isoolefins having 5 to 10 carbon atoms such as 2-methyl-1-butene, 2-methyl-1-pentene, 2-methyl-1-hexene, 2-ethyl-1-pentene, 2-ethyl-1-hexene and 2-propyl-1-heptene, or vinylaromatics such as styrene and α-methylstyrene, $C_1$-$C_4$-alkylstyrenes such as 2-, 3- and 4-methylstyrene and 4-tert-butylstyrene. The fraction of such comonomers should, however, not be too great. As a general rule the amount thereof should not exceed 20% by weight of the amount of all constituent units of the block. Besides the isobutene units and/or comonomers, the blocks may also comprise the initiator molecules or starter molecules used at the start of the polymerization, or fragments thereof. The polyisobutenes thus prepared may be linear, branched or star-shaped. They may have functional groups only at one chain end or else at two or more chain ends.

Starting materials for the hydrophobic blocks A are functionalized polyisobutenes. Functionalized polyisobutenes can be prepared starting from reactive polyisobutenes by providing the latter with functional groups in single-stage or multistage reactions that are known in principle to the skilled worker. Reactive polyisobutene is understood by the skilled worker to refer to polyisobutene having a very high fraction of terminal α-olefin groups. The preparation of reactive polyisobutenes is likewise known and described in detail, for example, in the above-cited documents WO 04/9654, pages 4 to 8, and WO 04/35635, pages 6 to 10.

Preferred embodiments of the functionalization of reactive polyisobutene comprise:

i) reaction with aromatic hydroxy compounds in the presence of an alkylation catalyst to give aromatic hydroxy compounds alkylated with polyisobutenes,
ii) reaction of the polyisobutene block with a peroxy compound to give an epoxidized polyisobutene,
iii) reaction of the polyisobutene block with an alkene that has a double bond substituted by electron-attracting groups (enophile), in an ene reaction,
iv) reaction of the polyisobutene block with carbon monoxide and hydrogen in the presence of a hydroformylation catalyst to give a hydroformylated polyisobutene,
v) reaction of the polyisobutene block with a phosphorus halide or a phosphorus oxychloride to give a polyisobutene functionalized with phosphono groups,
vi) reaction of the polyisobutene block with a borane and subsequent oxidative cleavage to give a hydroxylated polyisobutene,
vii) reaction of the polyisobutene block with an $SO_3$ source, preferably acetyl sulfate or oleum, to give a polyisobutene having terminal sulfo groups,
viii) reaction of the polyisobutene block with oxides of nitrogen and subsequent hydrogenation to give a polyisobutene having terminal amino groups.

With regard to all details for implementing the stated reactions we refer to the remarks in WO 04/35635, pages 11 to 27.

Particular preference is given to embodiment iii). With very particular preference maleic anhydride is used for this reaction. In that case the resulting polyisobutenes are functionalized with succinic anhydride groups (polyisobutenylsuccinic anhydride, PIBSA).

The molar mass of the hydrophobic blocks A is decided by the skilled worker in accordance with the desired application. In general the hydrophobic blocks (A) each have an average molar mass $M_n$ of 200 to 10 000 g/mol. $M_n$ is preferably 300 to 8000 g/mol, more preferably 400 to 6000 g/mol, and very preferably 500 to 5000 g/mol.

The hydrophilic blocks (B) are composed substantially of oxalkylene units. Oxalkylene units are, in a way known in principle, units of the general formula —$R^1$—O—. $R^1$ here is a divalent aliphatic hydrocarbon radical which may also, optionally, have further substituents. Additional substituents on the radical $R^1$ may be, in particular, O-containing groups, examples being >C═O groups or OH groups. One hydrophilic block may also, of course, comprise two or more different oxalkylene units.

The oxalkylene units can be, in particular, —$(CH_2)_2$—O—, —$(CH_2)_3$—O—, —$(CH_2)_4$—O—, —$CH_2$—$CH(R^2)$—O—, —$CH_2$—$CHOR^3$—$CH_2$—O—, where $R^2$ is an alkyl group, especially $C_1$-$C_{24}$-alkyl, or an aryl group, especially phenyl, and $R^3$ is a group selected from the group consisting of hydrogen, $C_1$-$C_{24}$-alkyl, $R^1$—C(═O)— and $R^1$—NH—C(═O)—.

The hydrophilic blocks may also comprise further structural units, such as ester groups, carbonate groups or amino groups, for example. They may additionally comprise the initiator or starter molecules used at the start of the polymerization, or fragments thereof. Examples comprise terminal groups $R^2$—O—, where $R^2$ is as defined above.

As a general rule the hydrophilic blocks comprise as their principal components ethylene oxide units —$(CH_2)_2$—O— and/or propylene oxide units —$CH_2$—$CH(CH_3)$—O, while higher alkylene oxide units, i.e., those having more than 3 carbon atoms, are present only in small amounts for the purpose of fine-tuning the properties. The blocks may comprise random copolymers, gradient copolymers, alternating copolymers or block copolymers of ethylene oxide and propylene oxide units. The amount of higher alkylene oxide units should not exceed 10%, preferably 5%, by weight. Preferred blocks are those comprising at least 50% by weight of ethylene oxide units, preferably 75% and more preferably at least 90% by weight of ethylene oxide units. With very particular preference they are pure polyoxyethylene blocks.

The hydrophilic blocks B are obtainable in a way which is known in principle: for example, by polymerizing alkylene oxides and/or cyclic ethers having at least 3 carbon atoms, and also, optionally, further components. They may also be prepared by polycondensation of dialcohols and/or polyalcohols, suitable starters, and, optionally, further monomeric components.

Examples of suitable alkylene oxides as monomers for the hydrophilic blocks B comprise ethylene oxide and propylene oxide and additionally 1-butene oxide, 2,3-butene oxide, 2-methyl-1,2-propene oxide (isobutene oxide), 1-pentene oxide, 2,3-pentene oxide, 2-methyl-1,2-butene oxide, 3-methyl-1,2-butene oxide, 2,3-hexene oxide, 3,4-hexeneoxide, 2-methyl-1,2-pentene oxide, 2-ethyl-1,2-butene oxide, 3-methyl-1,2-pentene oxide, decene oxide, 4-methyl-1,2-pentene oxide, styrene oxide, or are formed from a mixture of oxides from raffinate streams available industrially. Examples of cyclic ethers comprise tetrahydrofuran. It is of course also possible to use mixtures of different alkylene oxides. The skilled worker will make an appropriate selection from the monomers and/or further components in accordance with the desired properties of the block.

The hydrophilic blocks B may also be branched or star-shaped. Blocks of this kind are obtainable by using starter molecules having at least 3 arms. Examples of suitable starters comprise glycerol, trimethylolpropane, pentaerythritol or ethylenediamine.

The synthesis of alkylene oxide units is known to the skilled worker. Details are set out at length in, for example, "*Polyoxyalkylenes*" in Ullmann's Encyclopedia of Industrial Chemistry, 6th edition, Electronic Release.

The molar mass of the hydrophilic blocks B is decided by the skilled worker in accordance with the desired application. In general the hydrophilic blocks (B) each have an average molar mass $M_n$ of 500 to 20 000 g/mol. $M_n$ is preferably 1000 to 18 000 g/mol, more preferably 1500 to 15 000 g/mol, and very preferably 2500 to 8000 g/mol.

The synthesis of the block copolymers used inventively can preferably be performed by first preparing the hydrophilic blocks B separately and reacting them with the functionalized polyisobutenes in a polymer-analogous reaction to form block copolymers.

The constituent units for the hydrophilic and hydrophobic blocks in this case have complementary functional groups, i.e., groups which are able to react with one another with the formation of linking groups.

The functional groups of the hydrophilic blocks are, naturally, preferably OH groups, although they may also, for example, be primary or secondary amino groups. OH groups are particularly suitable as complementary groups for reaction with PIBSA.

In a further embodiment of the invention the synthesis of the blocks B may also be performed by reacting polyisobutenes having polar functional groups (i.e. blocks A) directly with alkylene oxides, with the formation of blocks B.

The structure of the block copolymers used inventively may be influenced by selecting type and amount of the starting materials for the blocks A and B and also the reaction conditions, in particular the sequence of addition.

The blocks A and/or B may be arranged terminally, i.e., joined only to one other block, or else they may be joined to two or more other blocks. The blocks A and B may be linked to one another, for example, linearly in alternating arrangement with one another. In principle any number of blocks may be used. As a general rule, however, there are not more than 8 blocks each of A and B respectively. This results, at its most simple, in a diblock copolymer of the general formula AB. The copolymers in question may additionally be triblock copolymers of the general formula ABA or BAB. It is of course also possible for two or more blocks to follow one another: for example, ARAB, BABA, ABABA, BABAB or ABABAB.

The copolymers in question may additionally be star-shaped and/or branched block copolymers or else comb block copolymers, in which more than two blocks A are attached to one block B or more than two blocks B are attached to one block A in each case. They may, for example, be block copolymers of the general formula $AB_m$ or $BA_m$, m being a natural number=3, preferably 3 to 6 and more preferably 3 or 4. In the arms or branches it is of course also possible for two or more blocks A and B to follow one another: for example, $A(BA)_m$ or $B(AB)_m$.

The synthesis possibilities are depicted below exemplarily for OH groups and succinic anhydride groups (labeled S), without any intention thereby that the invention should be restricted to the use of functional groups of these kinds.

HO—[B]—OH hydrophilic blocks having two OH groups
[B]—OH hydrophilic blocks having only one OH group
[B]—$(OH)_x$ hydrophilic bocks having x OH groups (x≧3)
[A]-S polyisobutene having one terminal group S
S-[A]-S polyisobutene having two terminal groups S
[A]-$S_y$ polyisobutene having y groups S (y≧3)

The OH groups may be linked in a way which is known in principle with the succinic anhydride groups S, with the formation of ester groups with one another. The reaction may be performed, for example, with heating and without solvent. Suitable reaction temperatures are, for example, from 80 to 150° C.

Triblock copolymers A-B-A are produced, for example, in a simple way by reacting one equivalent of HO—[B]—OH with two equivalents of [A]-S. This is depicted below by way of example with complete formulae. The example used is the reaction of PIBSA and a polyethylene glycol:

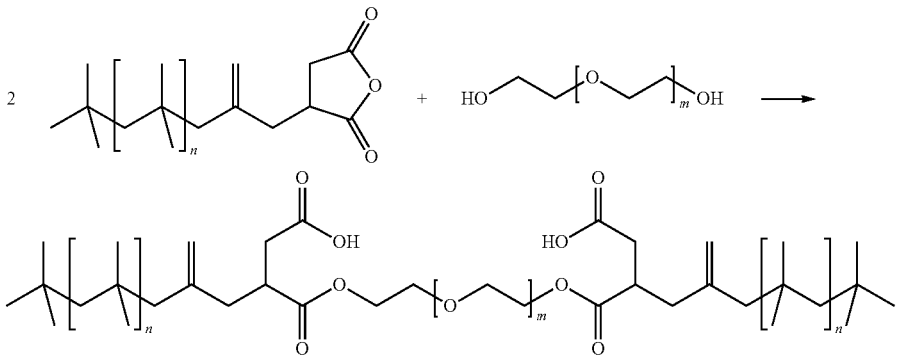

Here, n and m are, independently of one another, natural numbers. They are chosen by the skilled worker such as to give the molar masses defined at the outset for the hydrophilic blocks and the hydrophobic blocks, respectively.

Star-shaped or branched block copolymers $BA_x$ can be obtained by reacting [B]—$(OH)_x$ with x equivalents of [A]-S.

For the skilled worker in the field of polyisobutenes it is clear that the block copolymers obtained may also still have residues of starting materials, depending on the preparation conditions. Moreover, they may be mixtures of different products. Triblock copolymers of formula ABA may still comprise, for example, diblock copolymers AB and also functionalized and unfunctionalized polyisobutene. With advantage these products can be used without further purification for the application. It is, however, also possible, of course, for the products to be purified as well. Purification methods are known to the skilled worker.

One embodiment provides that the compatibilizer for preparing blends of the mixture is added in an amount between 0.05% by weight and 5% by weight relative to the total mixture.

A preferred embodiment provides that 0.05% by weight and 1% by weight relative to the total mixture of a compatibilizer for preparing blends are added to the mixture for the production of the extensible non-woven material.

Non-woven material having high extensibility and comprising polymer fibers can comprise according to the invention HDPE as an additional polymer not miscible with polypropylene.

In order to obtain non-woven materials having high extensibility, copolymers of polypropylene and polyethylene can be added to the polypropylene and to the additional polymer not miscible with polypropylene.

Advantageously, to produce the extensible non-woven material comprising polymer fibers, a mixture is used whose portion of polypropylene is on an order of magnitude between 75% by weight and 98% by weight and preferably between 85% by weight and 95% by weight relative to the total mixture.

An extension of the invention provides that for the production of the extensible non-woven material a polypropylene with an MFI between 15 g/10 min and 50 g/10 min (230° C., 2.16 kg), preferably between 20 g/10 min and 30 g/10 min (230° C., 2.16 kg), and an HDPE with an MFI between 3 g/10 min and 40 g/10 min (190° C., 2.16 kg), preferably between 5 g/10 min and 30 g/10 min (190° C., 2.16 kg), are used.

The invention further provides that for the production of the non-woven material having high extensibility polymer fibers in the form of filaments or staple fibers can be used.

According to one embodiment of the invention an extensible non-woven material is a thermally bonded, spunbonded fiber web of arbitrarily arranged, essentially continuous filaments which consist of polymer mixtures. In another embodiment of the invention an extensible non-woven material is a thermally bonded and carded web of staple fibers. The extensible non-woven material comprising polymer fibers can comprise additional fibrous components such as melt-blown microfibers. According to the invention the extensible non-woven material can also be formed as a textile composite and comprise additional components which are applied on one or both sides of the extensible non-woven material. In this case consolidated, partially consolidated, or unconsolidated layer material alone can be used as composite material with different extensibility, such as, for example, films, non-woven materials such as, for example, melt-blown and spun non-woven materials which have been produced in a melt-spinning, electrospinning, or solution spinning process or carded non-woven materials, wetlaids, airlaids, and laminates of films and/or non-woven materials, Thus the extensible non-woven material can comprise, for example, additional constituents in the form of a continuous or perforated polymer film, a film or a web of an elastic polymer, of another spunbonded fiber web, of an extensible mesh, of an arrangement of extensible or elastic strands, or of a web of melt-blown microfibers whereby, for example, a composite material with outstanding softness and drape is produced. Furthermore, the extensible non-woven material can be applied to a prefabricated material formed as non-woven material or film or combinations thereof.

It was an additional concept of the invention to set the extensibility of the non-woven material between the extensibility of a non-woven material of pure polypropylene and that of a non-woven material with an elastomer portion without using costly elastomer additives.

According to the invention non-woven material having high extensibility and comprising polymer fibers can have an elongation at break of 80-150% and a tear strength of 1.5-2 N per gram per unit area.

The inventive non-woven materials consist of fibers whose titer is in the range of 1 to 5 dtex, preferably between 1.5 and 3.5 dtex.

An extension of the invention provides for the use of a mixture for the production of a non-woven material having high extensibility and comprising polymer fibers of at least one polypropylene and one additional polymer not miscible with polypropylene as well as at least one block copolymer as a compatibilizer for preparing blends where the block copolymer comprises at least one hydrophobic block (A) essentially consisting of isobutene units and at least one hydrophilic block (B) essentially consisting of oxalkylene units and where the hydrophobic block (A) has a molar mass distribution $M_n$ between 200 and 10,000 g/mol and the hydrophilic block (B) has a molar mass distribution $M_n$ between 500 and 20,000 g/mol.

According to an additional concept of the invention a mixture for the production of a non-woven material having high extensibility and comprising polymer fibers, where the mixture comprises at least polyethylene and one additional polymer not miscible with polyethylene and an additional mixture constituent of one of the non-miscible polymers and a block copolymer as a compatibilizer for preparing blends, where the block copolymer comprises at least one hydrophobic block (A) essentially consisting of isobutene units and at least one hydrophilic block (B) essentially consisting of oxalkylene units, and where the hydrophobic block (A) has a molar mass distribution $M_n$ between 200 and 10,000 g/mol and the hydrophilic block (B) has a molar mass distribution $M_n$ between 500 and 20,000 g/mol.

According to the type of polymer there can be different degrees of miscibility with the use of polyethylene and polypropylene as base constituents of the mixture. Mixtures with more than two polymers can also be used. According to the invention additional miscible and non-miscible polymers can be added to the two non-miscible base constituents of the mixture in order to impart the additional properties or advantages to the non-woven materials to be formed therefrom taking into account mixing compatibility, viscosity, polymer crystallinity, or the phase area size.

In order to achieve a sufficiently high degree of mixing double-screw extruders are recommended in general. However, it has been found that, using the inventive mixture for the production of the non-woven materials themselves, single-screw extruders ensure a sufficient mixing of the individual components. In this technological simplification lies an additional advantage of the present invention.

To the inventive mixture which is subjected to a spinning process to form the non-woven material, additives can be added such as stabilizers, antioxidation agents, additives such as, for example, titanium dioxide, talcum, or quartz dust, other additives as well as other polymers such as, for example, diluting agents, additional compatibilizers for preparing blends, anti-blocking agents, additives modifying for impact resistance, softeners, UV stabilizers, pigments, dulling agents, lubricants, wetting agents, antistatic agents, nucleation agents, viscosity modifiers, water repellents and alcohol repellents, and the like. These additives can be used in order to exert an influence on the processing properties or product properties such as extrusion, quenching, drawing, laying, static and/or electric properties, bonding or wetting properties, or repellent properties of the mixture or of the extensible non-woven material. Specifically, polymeric additives can also be used in connection with the mixture which offers advantages in the processing of the mixture and/or in the final use of the extensible non-woven material or non-woven material composite.

According to an additional concept of the present invention, a process for the production of non-woven material having high extensibility and comprising polymer fibers is provided, where a mixture is used which comprises at least one polypropylene and an additional polymer not miscible with polypropylene as well as at least one block copolymer as a compatibilizer for preparing blends where the block copolymer comprises at least one hydrophobic block (A) essentially consisting of isobutene units and at least one hydrophilic block (B) essentially consisting of oxyalkylene units and where the polypropylene and additional polymer are mixed with one another in the presence of the compatibilizer for preparing blends under the action of heat, the mixture is subsequently spun into fibers in an open or closed process, the fibers are laid onto a device, and the fibers are subsequently thermobonded at discrete points in order to form a non-woven material.

An extension of the invention provides that a process for the production of non-woven material having high extensibility and comprising polymer fibers is provided in which a mixture is used, which comprises at least polyethylene and an additional polymer not miscible with polyethylene and an additional mixture constituent of at least one of the non-miscible polymers, and a block copolymer as a compatibilizer for preparing blends is used where the block copolymer comprises at least one hydrophobic block (A) essentially consisting of isobutene units and at least one hydrophilic block (B) essentially consisting of oxalkylene units. The compatibilizer for preparing blends is first mixed under heating with a part of the polymers used, and the obtained concentrate of polymers and compatibilizer for preparing blends in the form of a mixture constituent, are mixed with one another in a second step with the rest of the polymers under the action of heat. Subsequently the mixture is spun into fibers in an open or closed process where the fibers are laid onto a device and the fibers are subsequently thermobonded at discrete points in order to form a non-woven material.

In an embodiment of the process for the production of non-woven material having high extensibility the non-woven material is thermobonded in the temperature range from 115° C. to 160° C., preferably in the temperature range from 120° C. to 150° C.

The spinning of threads makes significant demands on the homogeneity of the melt exiting from the spinnerets. Thus, for example, the capacity of the melt to withstand a mechanical load may not be too small since otherwise the melt flow at the high take-up speed, which is indispensable in spinning threads, is interrupted and thus breaking of the threads occurs. On the other hand, the viscosity may not be too high since otherwise the thread cannot be sufficiently attenuated and the desired high fineness of the thread could thus not be achieved.

The extensible non-woven material can, for example, be produced by a customary spinning process in which no special perforated plates with particularly small spinning orifices are needed. Thus, polymers can also be used which reside in the MFI range of 10-100 g/10 min customary for spunbonded processes. The polymers are melted on single-screw extruders or double-screw extruders and, for example, extruded into continuous filaments through a perforated plate. The compatibility of the mixture is shown in the fact that from the perforations of the perforated plate continuous strands of thread are obtained. If a mixture is not compatible, then the individual phases of the mixture exit dropwise from the perforated plate and no continuous strands of threads are obtained.

After that, the filaments, if necessary, are cooled by air or air-water mixtures and stretched, in which mechanical devices for stretching of the filaments can also be used. In this case, stretching ratios of ca. 1:200 up to 1:400 are strived for. Subsequently, the filaments can be cooled in addition and are laid down in a random arrangement on a device in the form of a collecting surface. After the collecting of the filaments, any thermal, chemical, or mechanical bonding treatment can be carried out in order to form a bonded or consolidated non-woven material, which is characterized at discrete points by bonding points of the most different types.

In this case a thermal point bonding is preferred. For this, various technologies are known, but preferably calender rollers with a point bonding pattern are used.

All the patterns known in the state of the art can be used in typical embodiments, which use continuous or discontinuous patterns. The bonding points cover the surface of the extensible non-woven material or non-woven material composite preferably between 6 and 30%, more preferably between 8 and 20%, and most preferably between 12 and 18%. Extensions of the process provide that the extensible non-woven material or the extensible non-woven material composite, for example, can be compacted or consolidated or bonded via water-jet or air-jet or ultrasound or combinations of these processes. Also, the bonding point can also be produced by the application of a hot-melt adhesive.

Along with the bonding points the extensible non-woven material or non-woven material composite produced therefrom can also have perforations.

The type and extent of these bondings permit the filaments to extend over the entire range of the extension while the strength and integrity of the non-woven material or non-woven material composite is retained.

An advantage of the present invention is seen in the fact that the non-woven materials having high extensibility are produced in such a manner that the previously known complicated changes of the bonding pattern on the calender are no longer required to ensure a sufficient extensibility of the non-woven material with sufficient strength of the same.

An additional advantage of the present invention consists of the fact that the filaments do not have to be laid down in a certain preferred direction, in particular not preferably in the MD direction, before the thermobonding or other processes for the production of punctiform, linear, or areal consolidation of the non-woven material.

Alternatively to this, the extensible non-woven material can be a carded web of staple fibers which is produced according to known processes and then is subjected to a bonding in which thermal, chemical, or mechanical bonding treatments are used in order to impart to the non-woven material strength and flexibility.

According to the invention the continuous filaments or staple fibers which form the extensible non-woven material are polymer fibers which are formed from at least two non-miscible polymer components.

According to the process for the production of non-woven material having high extensibility, a compatibilizer for preparing blends is used. In one embodiment the proportion of the compatibilizer for preparing blends relative to the total mixture is between 0.05% by weight and 5% by weight, preferably between 0.1% by weight and 3% by weight.

An additional advantage found out in own spinning experiments, is that the effect of compatibilizing for preparing blends of the inventive copolymers is significantly more effective than that of compatibilizers known so far for preparing blends or mixtures of these, and hence clearly smaller amounts for compatibilizing of the non-miscible polymers are required.

An extension of the process provides that the amount of the polypropylene relative to the total mixture is between 75% by weight and 98% by weight, preferably between 85% by weight and 95% by weight (23, 24).

In the production of the inventive non-woven material and the use of the non-woven material in a non-woven material composite, additives which, for example, influence the surface properties of the fibers, but also fillers and reinforcing materials can be added to the mixture.

In the formation of the extensible non-woven material the polymer fibers can have different cross-sections depending on the intended use. The filaments as well as staple fibers can be round, flat, trilobal, or multi-lobal. Likewise, the filaments can have cavities or be formed as hollow fibers. The surfaces of the filaments can be smooth or fissured.

The inventive non-woven material having high extensibility and comprising polymer fibers can be used in a throw-away product, for example, in a product for feminine hygiene, diapers, incontinence products, wipes, and the like. As a constituent of a hygiene article, e.g. in the form of a diaper, the extensible non-woven material can be used in the area of the cuff or as an outer layer away from the body.

The inventive non-woven material can also be used in medical products or even as a constituent in packaging material, building product, or in the field of filter technology and in that case especially in applications which require non-woven materials with increased extensibility.

An extension of the invention provides for the use of a mixture for the production of non-woven material having high extensibility and comprising polymer fibers in a throw-away product, medical product, or building product.

With the aid of embodiment examples the invention will be explained in more detail with regard to the production of the mixture, the spinning of threads, and the production of non-woven material.

EXAMPLE 1

Production of a Compatibilizer for Preparing Blends with ABA Structure of PIBSA 1000 and Polyethylene Glycol 6000

Reaction of $PIBSA_{1000}$ (saponification value, SV=86 mg/gKOH) with Pluriol® E6000 (polyethylene oxide, $M_n \approx 6000$)

In a 4 l three-neck flask with internal thermometer, reflux condenser, and nitrogen tap were placed 783 g of PIBSA ($M_n$=1305; DP=1.5) and 1800 g of Pluriol® E6000 ($M_n \approx 6000$, DP=1.1). During heating to 80° C. the flask was evacuated 3 times and aerated with $N_2$. The mixture was subsequently heated to 130° C. and held at this temperature for 3 hours. Thereafter the product was allowed to cool to room temperature and examined by spectroscopy.

IR Spectrum (KBr) in $cm^{-1}$:

OH valence vibration at 3310; C—H valence vibration at 2956, 2890, 2745; C═O— valence vibration at 1732; C═C— valence vibration at 1640; additional vibrations of the PIB backbone: 1471, 1388, 1365, 1232; ether vibration of the Pluriols at 1109.

1-H-NMR spectrum ($CDCl_3$, 500 MHz, TMS, room temperature) in ppm:

Different intensities: 4.9-4.7 (C═C von PIBSA); 4.3-4.1 (C(O)—O—$CH_2$—$CH_2$—); 3.8-3.5 (O—$CH_2$—$CH_2$-O, PEO-chain); 3.4 (O—$CH_3$); 3.1-2.9; 2.8-2.4; 2.3-2.1; 2.1-0.8 (methylene and methine of the PIB chain)

EXAMPLE 2

Production of Filaments

A mixture of, relative to the total mixture, 94.9% by weight of Moplen HP560R, 5% by weight of HD 05862N, and 0.1% by weight of a block copolymer consisting of polyisobutylene and PEG (PIBSA/PEG 1000/6000) is fed to a single-screw extruder, melted, and mixed. At 235° C. the resulting melt is then pressed through a spinning plate having nozzles with a diameter of 0.4 mm and an L/D ratio of 4.

The spinning process is not disturbed by fiber breaks.

Filaments with a titer of 3.5 dtex, a specific tear force of 23 mN/dtex, and an extensibility of ca. 420% are obtained.

COMPARATIVE EXAMPLE

In comparison to example 1, a mixture of 95% by weight of Moplen HP560R (PP, MFI 25 g/10 min; 230° C., 2.16 kg) and 5% by weight of HD 05862N (HDPE, MFI 5 g/10 min; 190° C., 2.16 kg) is introduced into the extruder and spun under the same conditions. However, the melt filaments obtained cannot be drawn to fine threads since fiber breaks occur continuously.

EXAMPLE 3

Production of Non-Woven Materials

In a spinning system three different mixtures are spun into filaments, laid down to form non-woven materials, and bonded at the temperatures listed in Table 1.

The filaments consist of the following materials:

A) 100% Moplen HP560R (PP, MFI 25 g/10 min)

B) 93.9% Moplen HP560R, 6% HD05862N (HDPE, MFI 5 g/10 min), 0.1% PIBSA/BEG 1000/6000

C) 95.9% Moplen HP560R, 4% DMDA 8907NT7 (HDPE, MFI 6.75 g/10 min), 0.1% PIBSA/PEG 1000/6000

In this case a spinning plate with nozzle diameters of 0.6 mm was used.

The base weight of the non-woven materials produced is 20 g per $m^2$. The non-woven material obtained under A) serves as the reference. The mechanical properties of the threads obtained were determined following DIN 53 857. The strain values are summarized in Table 1.

TABLE 1

Experimental results in spinning non-woven material

| Material | Calender temperature (° C.) | Extension (%) MD | Extension (%) CD |
|---|---|---|---|
| A | 150 | 61 | 64 |
| A | 140 | 38 | 40 |
| A | 125 | 17 | 23 |
| B | 150 | 80 | 83 |
| B | 140 | 94 | 97 |
| B | 125 | 115 | 106 |
| C | 150 | 81 | 78 |
| C | 140 | 106 | 96 |
| C | 125 | 78 | 72 |

From material A it can be seen that lowering the calender temperature alone does not lead to an increase of the extensibility. In contrast to this, material B shows a clearly higher extensibility at a lower calender temperature than material A. In the case of material C the extension runs through a maximum, where an optimal bonding temperature of 140° C. was observed.

The invention claimed is:

1. Non-woven material having high extensibility and comprising polymer fibers of a mixture of at least one polypropylene and one additional polymer not miscible with polypropylene as well as at least one block copolymer as a compatibilizer for preparing blends where the block copolymer comprises at least one hydrophobic block (A) essentially consisting of isobutene units functionalized with succinic anhydride and—at least one hydrophilic block (B) essentially consisting of oxalkylene units, and wherein the at least one hydrophobic block (A) comprises a polyisobutenyl succinic anhydride having the following formula:

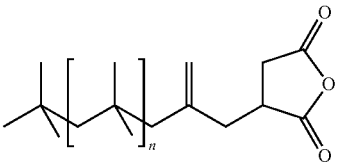

where n is a natural number that is selected such that the hydrophobic block (A) has an average molar mass of 200 to 10,000 g/mol.

2. Non-woven material having high extensibility according to claim 1 and comprising polymer fibers where the polymer not miscible with polypropylene is essentially present as a discontinuous phase finely dispersed phase within the polypropylene which forms the dominant continuous phase of the polymer fiber.

3. Non-woven material having high extensibility according to claim 1, characterized by the fact that the mixture comprises 0.05% by weight to 5% by weight of a compatibilizer for preparing blends relative to the weight of the total mixture.

4. Non-woven material having high extensibility according to claim 1, characterized by the fact that the mixture comprises 0.05% by weight to 1% by weight of a compatibilizer for preparing blends relative to the weight of the total mixture.

5. Non-woven material having high extensibility according to claim 1, characterized by the fact that the additional polymer is HDPE.

6. Non-woven material having high extensibility according to claim 1, characterized by the fact that the additional polymer is a copolymer of polypropylene and polyethylene.

7. Non-woven material having high extensibility and comprising polymer fibers according to claim 1, where the portion of polypropylene relative to the weight of the total mixture lies between 75% by weight und 98% by weight.

8. Non-woven material having high extensibility and comprising polymer fibers according to claim 1, where the portion of polypropylene relative to the weight of the total mixture lies between 85% by weight und 95% by weight.

9. Non-woven material having high extensibility and comprising polymer fibers according to claim 1, where a polypropylene with an MFI between 15 g/10 min and 50 g/10 min (230° C.; 2.16 kg), and—an HDPE with an MFI between 3 g/10 min and 40 g/10 min (190° C.; 2.16 kg) are used.

10. Non-woven material having high extensibility and comprising polymer fibers according to claim 1, where a polypropylene with an MFI between 20 g/10 min and 30 g/10 min (230° C.; 2.16 kg) and—an HDPE with an MFI between 5 g/10 min and 30 g/10 min (190° C.; 2.16 kg) are used.

11. Non-woven material having high extensibility according to claim 1, characterized by the fact that the polymer fibers are filaments.

12. Non-woven material having high extensibility according to claim 1, characterized by the fact that the polymer fibers are staple fibers.

13. Non-woven material having high extensibility according to claim 1, characterized by the fact that the non-woven material consists of fibers which have a fineness of 1 dtex to 5 dtex.

14. Non-woven material having high extensibility according to claim 1, characterized by the fact that the non-woven material consists of fibers which have a fineness of 1.5-3.5 dtex.

15. A throw-away product, medical product, or construction product produced from the non-woven material of claim 1.

16. Non-woven material having high extensibility and comprising polymer fibers of a mixture of at least one polypropylene and one additional polymer not miscible with polypropylene as well as at least one block copolymer as a compatibilizer for preparing blends where the block copolymer comprises at least one hydrophobic block (A) essentially consisting of isobutene units functionalized with succinic anhydride and—at least one hydrophilic block (B) essentially consisting of oxalkylene units, and wherein the at least one block copolymer has the following formula:

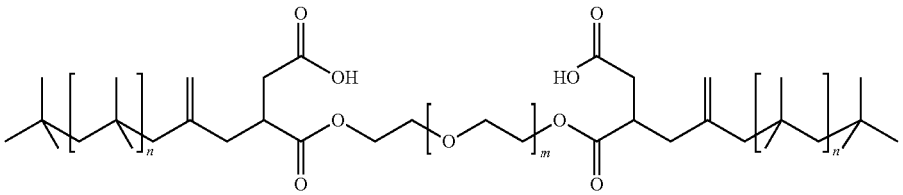

wherein n is a natural number that is selected such that the hydrophobic block (A) has an average molar mass of 200 to 10,000 g/mol, and m is a natural number that is selected such that the hydrophilic block (B) has an average molar mass of 500 to 20,000 g/mol.

17. Non-woven material having high extensibility according to claim 1 and comprising polymer fibers of a mixture of at least one polypropylene and one additional polymer not miscible with polypropylene as well as at least one block copolymer as a compatibilizer for preparing blends where the block copolymer comprises at least one hydrophobic block (A) essentially consisting of isobutene units functionalized with succinic anhydride and—at least one hydrophilic block (B) essentially consisting of oxalkylene units, and wherein the at least one block copolymer has an ABA formula.

18. Non-woven material having high extensibility according to claim 1 and comprising polymer fibers of a mixture of at least one polypropylene and one additional polymer not miscible with polypropylene as well as at least one block copolymer as a compatibilizer for preparing blends where the block copolymer comprises at least one hydrophobic block (A) essentially consisting of isobutene units functionalized with succinic anhydride and—at least one hydrophilic block (B) essentially consisting of oxalkylene units, and, wherein the at least one block copolymer has an BAB formula.

19. Non-woven material having high extensibility according to claim 1 and comprising polymer fibers of a mixture of at least one polypropylene and one additional polymer not miscible with polypropylene as well as at least one block cool mer as a compatibilizer for preparing blends where the block copolymer comprises at least one hydrophobic block (A) essentially consisting of isobutene units functionalized with succinic anhydride and—at least one hydrophilic block (B) essentially consisting of oxalkylene units, and wherein the at least one hydrophobic block (A) includes at least two terminal succinic anhydride groups.

* * * * *

UNITED STATES PATENT AND TRADEMARK OFFICE

CERTIFICATE OF CORRECTION

PATENT NO. : 8,093,162 B2
APPLICATION NO. : 11/914857
DATED : January 10, 2012
INVENTOR(S) : Hartl et al.

It is certified that error appears in the above-identified patent and that said Letters Patent is hereby corrected as shown below:

Column 10,

Line 13, “bocks” should read --blocks--.

Column 20,

Lines 1 and 2, “cool mer” should read --copolymer--.

Signed and Sealed this
Seventh Day of August, 2012

David J. Kappos

David J. Kappos
*Director of the United States Patent and Trademark Office*